US005775441A

United States Patent [19]

Sakuragi et al.

[11] Patent Number: 5,775,441

[45] Date of Patent: Jul. 7, 1998

[54] POWER DRIVEN STRIKING TOOL

[75] Inventors: Masaki Sakuragi; Yoshihiro Kasuya, both of Anjo, Japan

[73] Assignee: Makita Corporation, Aichi-pref., Japan

[21] Appl. No.: 651,670

[22] Filed: May 21, 1996

[30] Foreign Application Priority Data

May 25, 1995 [JP] Japan ..... 7-126756

[51] Int. Cl.[6] ..... B25D 9/04

[52] U.S. Cl. ..... 173/200; 173/122; 173/212

[58] Field of Search ..... 173/17, 212, 200, 173/201, 118, 128, 133, 104

[56] References Cited

U.S. PATENT DOCUMENTS

| | | | |
|---|---|---|---|
| 4,336,848 | 6/1982 | Wanner | 173/139 |
| 4,442,906 | 4/1984 | Simpson | 173/48 |
| 4,462,467 | 7/1984 | Weingartner | 173/105 |
| 4,611,670 | 9/1986 | Chromy | 175/116 |
| 4,732,219 | 3/1988 | Chromy | 173/116 |
| 5,099,926 | 3/1992 | Fushiya et al. | 173/17 |
| 5,111,890 | 5/1992 | Ranger et al. | 173/104 |
| 5,346,023 | 9/1994 | Takagi et al. | 173/178 |

FOREIGN PATENT DOCUMENTS 961880 10/1956 Germany .

*Primary Examiner*—Scott A. Smith

*Attorney, Agent, or Firm*—Lahive & Cockfield, LLP

[57] ABSTRACT

An airflow regulation arrangement for regulating the impact of the strikes delivered from a striking member (6) to an intermediate member (10) and a bit, thus reducing the vibration, and also for regulating the impact of recoils of the striking member (6) is disclosed for use in an electrical hammer (1). The airflow regulation arrangement comprises an air inlet (14) provided in an air chamber (5) in a cylinder (3) of the electrical hammer (1), exhaust ports (15) provided in a second air chamber (9), and air passages (16) in communication with the air inlet (14) and the exhaust ports (15). The air passages (16) are connected to choke passages (17), the cross sectional area of which is one fifth to one sixth of that of the air passages (16). In a forward stroke of the striking member (6), the compressed air forced out of the second air chamber (9) is gradually released out of the cylinder (3) after passing through the air passages (16) the choke passages (17), which causes a gradual pressure increase in the second air chamber (9) as the striking member (6) moves forward, thereby appropriately braking the striking member (6) and checking the excessive acceleration and the impact of the strikes of the striking member (6).

7 Claims, 5 Drawing Sheets

POWER DRIVEN STRIKING TOOL

BACKGROUND OF THE INVENTION

1. Field of the Invention

The present invention relates to a power driven striking tool. More particularly, the present invention pertains to improvements in a power driven striking tool, such as an electric hammer and an hammer drill, comprising a piston reciprocable in a cylinder, a striking member that is pneumatically interlocked with and actuated by a piston through an air chamber for transmitting impacts to an attached bit in forward strokes.

2. Description of the Prior Art

FIG. 7 is a fragmentary vertical sectional view of a conventional electrical hammer 120. A cylindrical barrel 121 has a cylinder 122 coaxially mounted therein. A piston 123, an air chamber 124, and a striking member 125 are provided in the cylinder 122. The piston 123, connected to a motor via a crank mechanism (neither shown), makes reciprocating motion as the crank mechanism converts and transmits the rotation of the motor thereto. The striking member 125 is pneumatically interlocked with and actuated by the piston 123 via the air chamber 124. An intermediate member 128 is mounted in a tool holder 126 in front of the striking member 125. A second air chamber 127 is formed between the intermediate member 128 and the striking member 125. As the rotation of the motor causes the piston 123 to advance in a forward stroke, the striking member 125 is pneumatically actuated to advance until it strikes the intermediate member 128, thereby transmitting an impact to a bit 129 inserted in the intermediate member 128.

Reference numeral 130 designates an air inlet provided in the air chamber 124 while reference numeral 131 designates a plurality of exhaust ports provided in the peripheral wall of the second air chamber 127. In a forward stroke of the striking member 125, the air in the second air chamber 127 is released into the outside through the exhaust ports 131 and air passages 132 provided between the cylinder 122 and the barrel 121. In a return stroke of the piston 123, air is admitted into the air chamber 124 through an air inlet 130 to prepare for the next strike. In idle operation, on the other hand, the striking member 125 is thrust forward and gripped in an O-ring 133 provided as a striking member catcher, disconnecting the pneumatic interlock with the piston 123.

In the above conventional striking tool, the striking member 125 strikes the intermediate member 128 while increasing speed, so that unnecessarily powerful strikes are delivered to the bit 129. Accordingly, the main body of the electric hammer is subjected to strong recoils from the bit 129, the impact and vibration of which affect the durability and the workability of the electric hammer as well as its operation efficiency. To overcome these disadvantages, an improved configuration has been proposed in which the striking member 125 collides against a hermetically sealed second air chamber, which is not in communication with air passages 132, so that the striking member 125 is braked by the air cushion of the second air chamber 127. This configuration, however, tends to apply an excessive brake on the striking member 125, with insufficient impacts delivered to the bit 129. Moreover, the temperature of the air sealed inside the second air chamber rises very high when repeatedly compressed, thus also raising the temperature of the cylinder 122 and the barrel 121. This necessitates thickening the entire housing, resulting in a heavier tool and a higher manufacturing cost.

Furthermore, an increased air pressure in the hermetically sealed second air chamber at times prevents the O-ring 133 from catching the striking member 125.

SUMMARY OF THE INVENTION

Therefore, an object of the present invention is to provide an improved power-driven striking tool with a higher durability, operation efficiency, and workability by appropriately regulating the strikes delivered from a striking member to a bit and by reducing the vibration and the impact of the recoil of the striking member during operation.

The above and other related objects are realized by providing in a power driven striking tool: a cylinder; a piston reciprocable in the cylinder; a first air chamber provided in the cylinder; a bit attached to the nose of the power driven striking tool; a striking member pneumatically interlocked with an actuated by the piston via the first air chamber during operation; a second air chamber formed between the striking member and the bit; and an airflow regulation means for restricting the amount of air forced out of the second air chamber to the outside of the cylinder when the air in the second air chamber is compressed by the striking member in forward motion. The air flow regulation means may be formed by air passages in communication with the second air chamber and choke passages connecting the air passages to the outside of the cylinder. The air passages and the choke passages are both preferably provided between the cylinder and the housing supporting the cylinder.

As an alternative construction, the striking member may be formed cylindrical having an opening at the rear end so that the piston may be reciprocally mounted in the striking member and so that the first air chamber may be formed between the front, closed end of the striking member and the piston. In this case, an airflow regulation means in the form of air passages are provided between the cylinder and the striking member for communicating the second air chamber with the inside of the cylinder behind the piston when the striking member is in the most forward position in normal strike operation. The rear portion of each air passage is formed into a choke passage with a cross sectional area smaller than that of the air passage.

In operation, the striking member travels forward to compress the air in the second air chamber, thereby forcing air out of the second air chamber. At this moment, the airflow regulation means restricts the amount of air out of the second air chamber into the air passages, the choke passages, and eventually the outside of the cylinder, thereby permitting gradual outflow of air from the second air chamber. Consequently, the air pressure in the second air chamber gradually rises checking the acceleration of the striking member and cushioning the impact and the subsequent recoil of the striking member.

In idle operation, since the movement of the striking member is not regulated any more than necessary by the air cushion of the second air chamber, a catcher can securely grip the striking member. When pushed fully back into a tool holder again, the bit abuts against and pushes back the strike member to resume normal strike operation.

DETAILED DESCRIPTION OF THE PREFERRED EMBODIMENTS

The present invention will now be explained with specific reference to the attached drawings.

Embodiment 1

Figure 1:
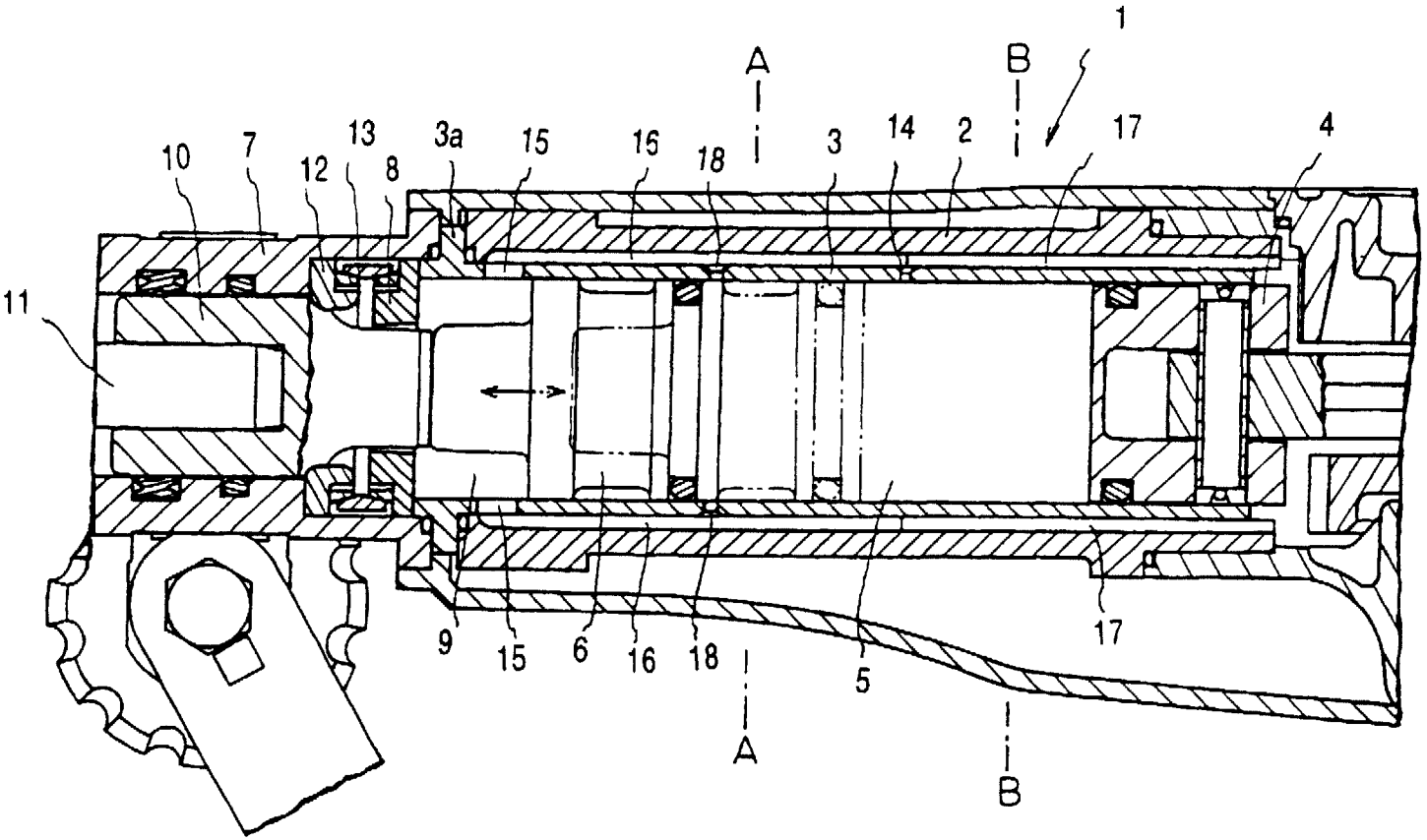
FIG. 1 is a fragmentary vertical sectional view of an electric hammer in accordance with the present invention.

Referring to FIG. 1, reference numeral 1 designates an electric hammer in which a cylindrical barrel 2 is provided with a cylinder 3 coaxially mounted therein. A piston 4, a first air chamber 5, and a striking member 6 are provided in the cylinder 2. The piston 4, connected to a motor via a crank mechanism (both not shown), makes reciprocating motion as the crank mechanism converts and transmits the rotation of the motor thereto. The striking member 6 is pneumatically interlocked with and actuated by the piston 4 via the first air chamber 5 during normal operation. At the front of the barrel 2 (the left side in FIG. 1 is referred to as the front hereinafter), a tool holder 7 is coaxially secured thereto by bolts (not shown) across a flange 3*a* formed on the periphery of the front end of the cylinder 3. A catcher 8 is interposed between the tool holder 7 and the cylinder 3. A second air chamber 9 is formed between the catcher 8 and the striking member 6 for cushioning the striking member 6. Provided in the bore of the tool holder 7 is an intermediate member 10 which is movable in both axial directions. A bit 11 is attached to the striking tool 1 through the opening (not shown) at the front end of the tool holder 7. When fully pushed in, the bit 11 abuts against and moves the intermediate member 10, which in turn abuts against an annular bearing 12 while penetrating the catcher 8 into the second air chamber 9 in preparation for receiving strikes from the striking member 6. Reference numeral 13 designates a ring spring provided with a ridge and pitched sides on the inner surface, which is engaged with the pitched surfaces of the catcher 8 and the bearing 12 for urging the catcher 8 and the bearing 12 in the rear and the front directions, respectively.

Figure 2:
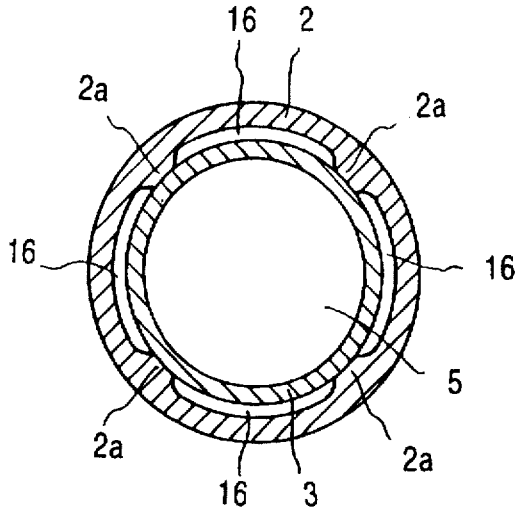
FIG. 2 is a cross sectional view showing only the barrel and the cylinder of the electric hammer of FIG. 1 taken on line A—A.
Figure 3:
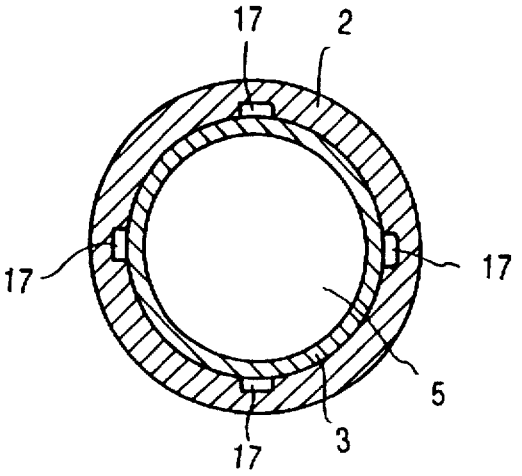
FIG. 3 is another cross sectional view showing only the barrel and the cylinder of the electric hammer of FIG. 4 taken on line B—B.

The first air chamber 5 of the cylinder 3 is provided with an air inlet 14 while the second air chamber 9 is provided with a plurality of exhaust ports 15. As can be seen in FIG. 1, the exhaust ports 15 are in communication with their respective air passages 16 provided between the barrel 2 and the cylinder 3 at the front of cylinder 3. As shown in FIG. 2, each air passage 16 is defined by the outer surface of the cylinder 3, a groove in the barrel 2, and a pair of ribs 2*a*, which support the outer surface of the cylinder 3. Also, the air passages 16 are connected to the outside of the cylinder 3 via choke passages 17 provided at the rear of the cylinder 3, the cross sectional area of which ranges from one fifth to one sixth of that of the air passages 16. Reference numeral 18 designates a pair of small holes for preventing idle strikes provided in the cylinder 3 between the air inlet 14 and the exhaust ports 15. In normal operation, the small holes 18 are covered by the striking member 6 in a forward position as shown in solid lines in FIG. 1. During idle, the small holes 18 are no longer covered by the striking member 6 in a further forward position for communicating the first air chamber 5 with the air passages 16, thereby disconnecting the pneumatic interlock between the piston 4 and the striking member 6.

In the normal strike operation of the electric hammer thus constructed, in which the bit 11 is pushed in until the intermediate member 10 abuts against the bearing 12, the piston 4 is advanced by the rotation of the motor 4. This in turn advances the striking member 6 by the air spring effect of the first air chamber 5 until it strikes the intermediate member 10, thereby transmitting the strike to the bit 11. While the striking member 6 is thrust forward, the air in the second air chamber 9 is compressed and forced into the air passages 16 through the exhaust ports 15. Then, the airflow is restricted at the choke passage 17 and gradually released out of the cylinder 3, so that the air pressure in the second air chamber 9 gradually increases as the advance of the striking member 6. This gradual pressure buildup serves as a brake on and checks the acceleration of the striking member 6, thereby limiting the collision speed thereof against the intermediate member 10. This braking effect by the air cushion of the second air chamber 9 is so set by the cross sectional area of the choke passages 19 as to limit the collision speed of the striking member 6 while ensuring a sufficient impact thereof.

In a return stroke of the piston 4, the striking member 6 moves backwards, when the air that has been introduced into the air passages 16 in the previous forward stroke is sucked into the first air chamber 5 through the air inlet 14 to replenish air for the next strike.

In the operation of the electric hammer 1, the above forward and return strokes are repeated to deliver strikes to the bit 11. Since the strikes of the striking member 6 delivered to the intermediate member 10 and the bit 11 are appropriately regulated by the air cushion of the second air chamber 9, the recoil of the bit 11 to the main body of the electrical hammer 1 is minimized so that neither the vibration nor the impact of the recoil significantly affects the internal mechanisms or the workability of the electrical hammer 1. These effects are realized by decreasing airflow with the choke passages 17, as they causes loss of the energy of the compressed air, thus effectively reducing undesirable vibration.

When the operation is switched over to idling, the bit 11 and the intermediate member 10 are thrust forward into the tool holder 7 by the first strike of the striking member 6 after the switchover. Since the movement of the striking member 6 is not regulated any more than necessary by the air cushion of the second air chamber 9 as described above, the catcher 8 can securely grip the striking member 6 by the top end. As a result, the pneumatic interlock between the striking member 6 and the piston 4 is disconnected, thereby preventing further idle strikes. When pushed fully back into the tool holder 7 again, the bit 11 abuts against and pushes back the intermediate member 10. The intermediate member 10 in turn dislodges the striking member 6 from the catcher 8, placing the electric hammer 1 in operational condition.

In the above embodiment, the air passages 16 in communication with the second air chamber 9 and the choke passages 17 having a smaller cross section than that of the air passages 16 constitute an airflow regulation mechanism for reducing the airflow in a manner of a bottleneck. However, as long as the desired outflow is obtained, the airflow regulation mechanism may be realized by some other form or configuration; for example, tapered air passages may replace the combination of the air passages 16 and the choke passages 17. Alternatively, the desired air outflow regulation can be also achieved by adjusting the cross sectional area or the number of the exhaust ports 15 provided in the cylinder 3.

Moreover, the air passages 16 and the choke passages 17, though formed by recesses, grooves, and ridges on the inner surface of the barrel 2 in the above embodiment, may be formed by similar recesses, grooves, and ridges on the outer surface of the cylinder 3. These passages may be formed in the peripheral wall of the cylinder 3 instead of between the barrel 2 and the cylinder 3.

Although the present invention has been so far explained as applied to an electric hammer including an intermediate member mounted between a striking member and a bit, it will be readily understood by those skilled in the art that the present invention is applicable to the type of striking tool without an intermediate member or some other configuration, as exemplified in the following second embodiment.

Embodiment 2

Figure 4:
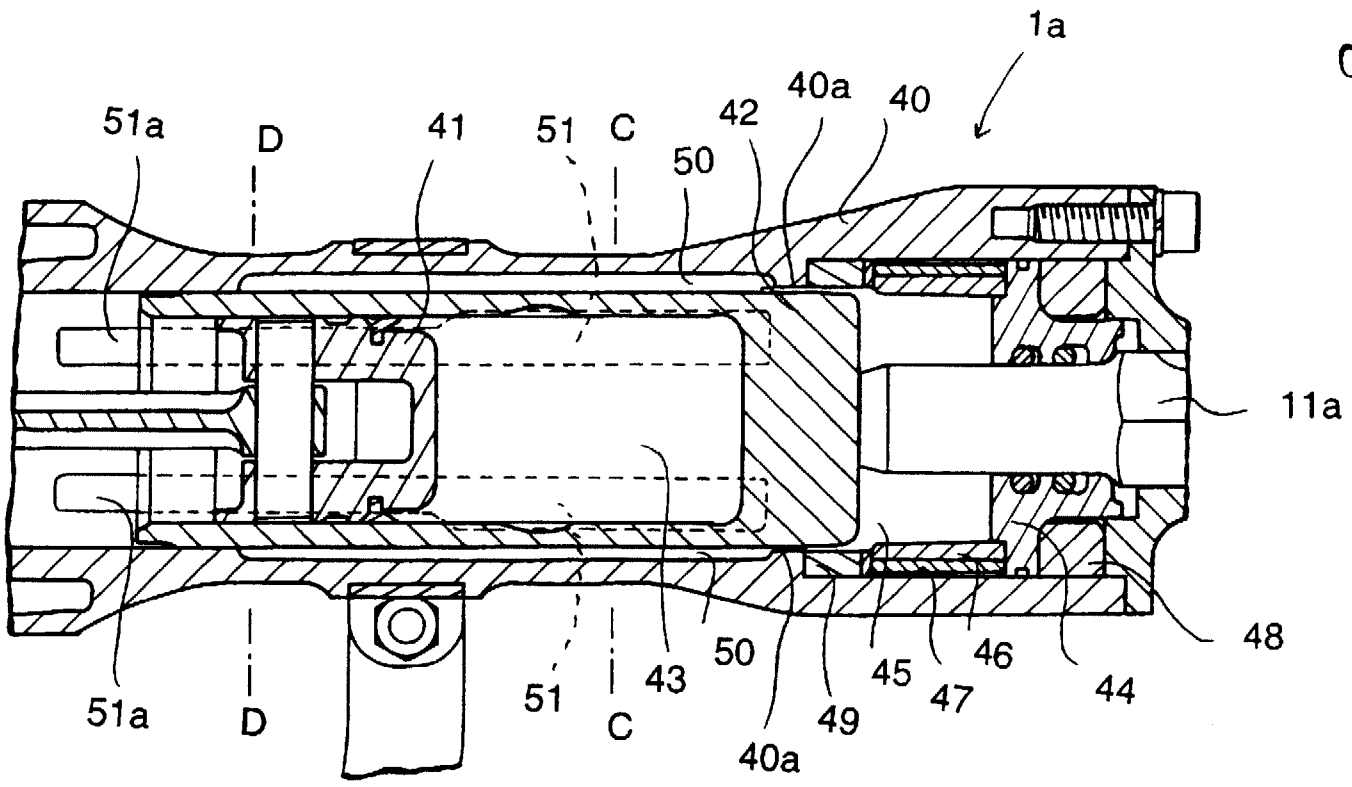
FIG. 4 is a fragmentary vertical sectional view of an electric hammer without an intermediate member in accordance with the present invention.

Referring to FIG. 4, reference numeral la is an electric hammer including a cylinder 40 which contains a piston 41 reciprocable therein and a striking member 42 which can be pneumatically interlocked with and actuated by the piston 41. In this embodiment, the striking member 42 is configured cylindrical with an opening at its rear end (the rear is the left side as seen in FIG. 4.), into which the piston 41 is inserted forming an air chamber 43 in front thereof inside the striking member 42. Also, provided in front of the striking member 42 is a sealing member 44 into which a bit 11*a* is inserted. A second air chamber 45 is formed between the sealing member 44 and the striking member 42. A catcher 46 whose inner diameter is progressively smaller toward its front end and a coaxial rubber sleeve 47 slipped over the catcher 46 are fitted on the inner surface of the second air chamber 45. Reference numerals 48 and 49 denote urethane rings for cushioning impacts.

Figure 5:
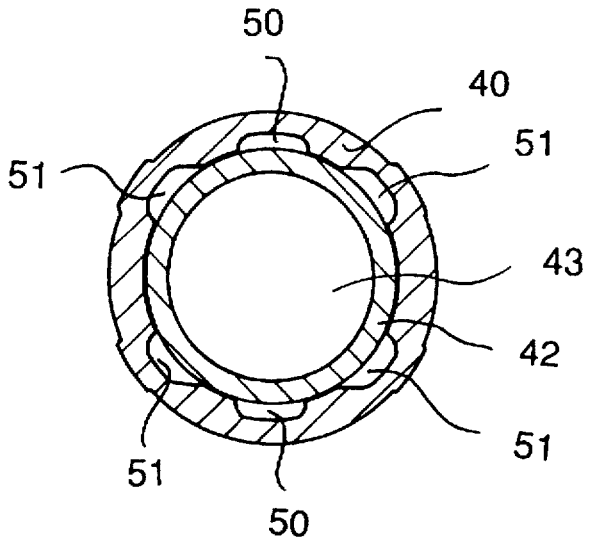
FIG. 5 is a cross sectional view showing only the cylinder and the striking member of the electric hammer of FIG. 4 taken on line C–C.
Figure 6:
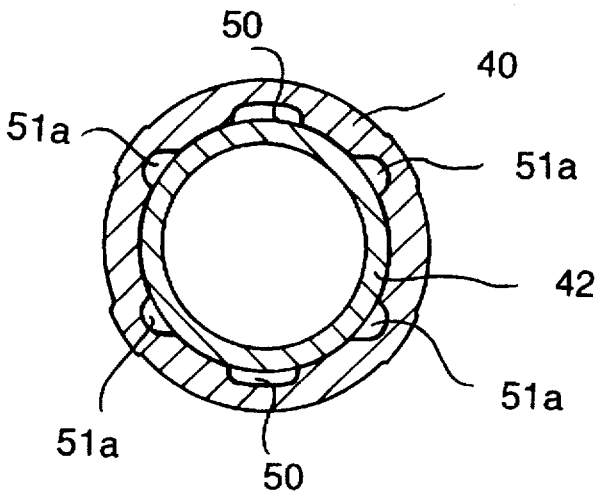
FIG. 6 is another cross sectional view showing only the cylinder and the striking member of the electric hammer of FIG. 4 taken on line D–D.
Figure 7:
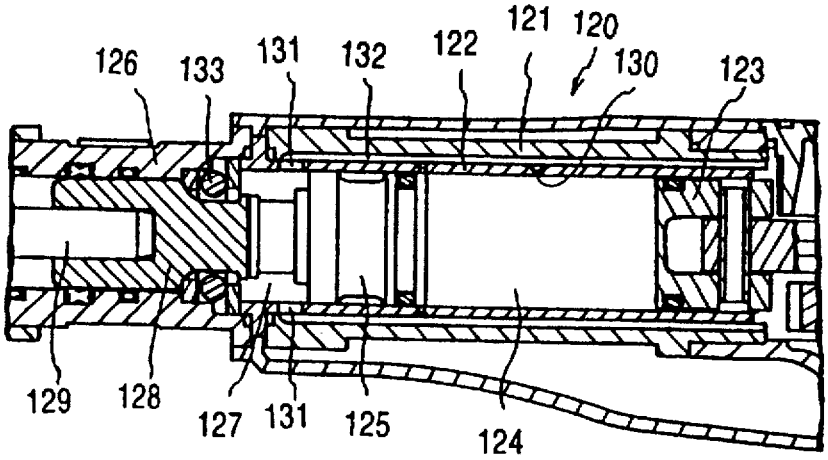
FIG. 7 is a fragmentary vertical sectional view of a conventional electric hammer.

As also shown in FIGS. 5 and 6, six air passages 50 and 51 are formed by grooves on the inner surface of the cylinder 40 in the axial direction. The two air passages 50, which are seen on the top and the bottom of the striking member 42 in FIG. 4, have the uniform width. In the most forward position of the striking member 42 in normal striking operation (as shown in FIG. 4), the front ends of both air passages 50 are in communication with the second air chamber 45 via a gap 40*a* formed between the striking member 42 and the inner surface of the cylinder 40 while the rear ends thereof are sealed by the inner surface to inhibit airflow into or out of the air passages 50. On the other hand, while the front ends of the air passages 51 are likewise in communication with the second air chamber 45 via a gap 40*a* formed between the striking member 42 and the inner surface of the cylinder 40 in the most forward position of the striking member 42 in normal striking operation, the rear ends thereof are extended beyond the rear end of the striking member 42 and in communication with the inside of the cylinder 40 behind the piston 41. The rear portion of each air passage 51 is narrowed at an intermediate point to form thereafter a choke passage 51*a* the cross sectional area of which is half of that of the air passage 51.

In the normal strike operation of the electric hammer la, the striking member 42 is pneumatically interlocked with and actuated by the piston 41 by the reciprocating motion of the piston 41 thereby to strike the rear end of the bit 11*a*. In a forward stroke of the striking member 42, the compressed air inside the second air chamber 45 flows into each of the air passages 50 and 51 via the gap 40*a*. Since the air passages 50 are sealed at the rear ends, the air flows out behind the piston 41 only through the four air passages 51 after the rear end of the striking member 42 has moved ahead of the rear ends of the choke passages 51*a* of the air passages 51. The air is not discharged behind the cylinder 42 instantaneously but gradually as the airflow is restricted by the narrow choke passages 51*a*. Consequently, the air pressure in the second air chamber 45 is gradually increased braking the striking member 42, so that the striking member 42 is prevented from accelerating as colliding against the bit 11.

In the beginning of idle operation, the striking member 42 is thrust forward and caught by the catcher 46 in a further forward position than the one shown in FIG. 4. When the striking member 42 is in this idle, further forward position, the rear ends of the air passages 50 are no longer blocked but in communication with the rear of the piston 40 as well, so that the compressed air is quickly forced out of the second air chamber 45 so as not to prevent the catcher 46 from catching the striking member 42.

In the second embodiment as well, the number or configuration of the air passages may be modified as long as the desired outflow of air is obtained; for example, tapered air passages may be formed in replace of the combination of the air passages 51 and the choke passage 51*a*. Moreover, the air passages 50 and 51, though formed by grooves on the inner surface of the cylinder 40 in the above embodiment, may be formed in the peripheral wall of the cylinder 3 instead of between the cylinder 40 and the striking member 42.

As is apparent from the foregoing explanation, the improved power-driven striking tool in accordance with the present invention achieves a higher durability and a superior workability by appropriately controlling the strikes transmitted from the striking member to the bit and by reducing the undesirable vibration and impact of the recoil during operation.

As there may be many other modifications, alterations, and changes without departing from the scope or spirit of essential characteristics of the present invention, it is to be understood that the above embodiments are only illustrative and not restrictive in any sense. The scope or spirit of the present invention are limited only by the terms of the appended claims.

What is claimed is:

1. A power driven striking tool comprising:

a cylinder, a piston reciprocable in the cylinder;

a first air chamber provided in the cylinder;

a bit mounted in front of the cylinder;

a striking member pneumatically interlocked with and actuated by the piston via the first air chamber for transmitting impacts to the bit by forward motion thereof;

a second air chamber formed between the striking member and the bit; and an air flow regulation means for restricting the amount of air forced out of the second air chamber to the outside of the cylinder when the air in the second air chamber is compressed by the striking member in forward motion, the air flow regulation means including air passages provided between the cylinder and a cylindrical housing for supporting the cylinder, the air passages being disposed at the front of the cylinder to communicate with the second air chamber, and choke passages provided between the cylinder and the housing, the choke passages having a smaller cross sectional area than that of the air passages and being disposed at the rear of the cylinder to connect the respective air passages to the outside of the cylinder.

2. A power driven striking tool in accordance with claim 1, wherein the cross sectional area of the choke passages is in the range of one fifth to one sixth of that of the air passages.

3. A power driven striking tool in accordance with claims 2, wherein the air passages are formed by grooves on an inner surface of the housing.

4. A power driven striking tool in accordance with claim 1, wherein the airflow regulation means is formed by grooves on an inner surface of the housing.

5. A power driven striking tool in accordance with claim 1, further comprising an intermediate member interposed between the striking member and the bit for transmitting impacts from the striking member to the bit.

6. A power driven striking tool in accordance with claim 1, wherein the striking member is a cylinder with an opening formed at its rear end with the piston inserted in the bore of the striking member so as to form the first air chamber in the striking member.

7. A power driven striking tool in accordance with claim 6, wherein the air passages are formed between the cylinder and the striking member for communicating the second air chamber with the inside of the cylinder behind the piston when the striking member is in the most forward position in normal strike operation, and the rear portion of each air passage is narrowed to form each of the choke passages, the cross sectional area of which is smaller than that of the air passage.

* * * * *